United States Patent [19]

Ziegler et al.

[11] Patent Number: 4,779,588

[45] Date of Patent: Oct. 25, 1988

[54] AIR-COOLED MULTI-CYLINDER INTERNAL COMBUSTION ENGINE

[75] Inventors: Gerhard Ziegler, Besigheim; Karl Gregotsch, Heimerdingen; Walter Mittermeier, Tamm, all of Fed. Rep. of Germany

[73] Assignee: Dr. Ing. h.c.F. Porsche Aktiengesellschaft, Fed. Rep. of Germany

[21] Appl. No.: 49,827

[22] Filed: May 15, 1987

[30] Foreign Application Priority Data

May 16, 1986 [DE] Fed. Rep. of Germany ..... 3616636

[51] Int. Cl.[4] ..... F01P 1/02; F02F 1/08

[52] U.S. Cl. ..... 123/41.61

[58] Field of Search ..... 123/41.69, 41.7, 41.58–41.62, 123/41.6, 41.61

[56] References Cited

U.S. PATENT DOCUMENTS

| | | | |
|---|---|---|---|
| 2,729,201 | 1/1956 | Rohm | 123/41.6 |
| 4,047,508 | 9/1977 | Schramm | 123/41.6 |
| 4,515,111 | 5/1985 | Vosmeyer et al. | 123/41.69 X |
| 4,633,823 | 1/1987 | Haas et al. | 123/41.61 |

FOREIGN PATENT DOCUMENTS

| | | | |
|---|---|---|---|
| 1205772 | 11/1965 | Fed. Rep. of Germany . | |
| 1349691 | 3/1964 | France | 123/41.6 |

*Primary Examiner*—Tony M. Argenbright
*Assistant Examiner*—Eric R. Carlberg
*Attorney, Agent, or Firm*—Barnes & Thornburg

[57] ABSTRACT

An air-cooled multi-cylinder internal combustion engine in which cooling air flows through a cylinder row transversely to the cylinders. A one-piece deflection part made of light-metal or plastic material and covering all cylinders is arranged as air guide device at the cooling air discharge side.

12 Claims, 4 Drawing Sheets

IV
IV
13
15
12

7
10
4'
4
12
11
10
15
V
V
3'
13
14
3
11
7
10
2'
2

AIR-COOLED MULTI-CYLINDER INTERNAL COMBUSTION ENGINE

BACKGROUND AND SUMMARY OF THE INVENTION

The present invention relates to an air-cooled multi-cylinder internal combustion engine whose cylinders, arranged in a row (in-line) and clamped-in between the associated cylinder heads and the crankcase, are cast individually and are provided externally with transversely extending ribs for cooling purposes.

Such an internal combustion engine is disclosed in the DE-AS No. 12 05 772. The cooling air flowing transversely to the cylinders flows along the wide side of the cross ribs and is then deflected at the rear cooling air discharge side of the cylinders by columns shaped favorably from an aerodynamic point of view. Additionally, guide baffle or deflector plates are attached at the columns, however, nothing is stated in this prior art publication about how these plates are to be fastened. Customarily, such guide baffle or deflector plates are threadably secured and cause an undesired noise emission.

It is the object of the present invention to provide an air guide arrangement which can be manufactured and installed at low cost and does not represent an additional noise source.

A one-piece deflection member covering all cylinders at their cooling-air discharge side serves as solution to the underlying problems, which can be cast of light metal or even injection-molded of plastic material. For purposes of increasing its form rigidity, it is constructed double-walled. This deflection part is threadably connected either with the crankcase or with the cylinders. In the latter case, it can be used at the same time as knock bridge in that it further transmits the knock noises of all cylinders connected with the same to a knock sensor threadably secured thereon in the center thereof. If the deflection part is made of a material that has the same thermal coefficient of expansion as the crankcase, it follows the length expansions thereof during temperature changes so that the deflection part can be rigidly screwed onto the cylinders secured in the crankcase. Otherwise, also a compensating threaded connection can be selected which enables a differing length expansion of the deflection part and of the crankcase.

BRIEF DESCRIPTION OF THE DRAWINGS

These and other objects, features and advantages of the present invention will become more apparent from the following description when taken in connection with the accompanying drawing which shows, for purposes of illustration only, two embodiments in accordance with the present invention, and wherein.

DETAILED DESCRIPTION OF THE DRAWINGS

Figure 1:
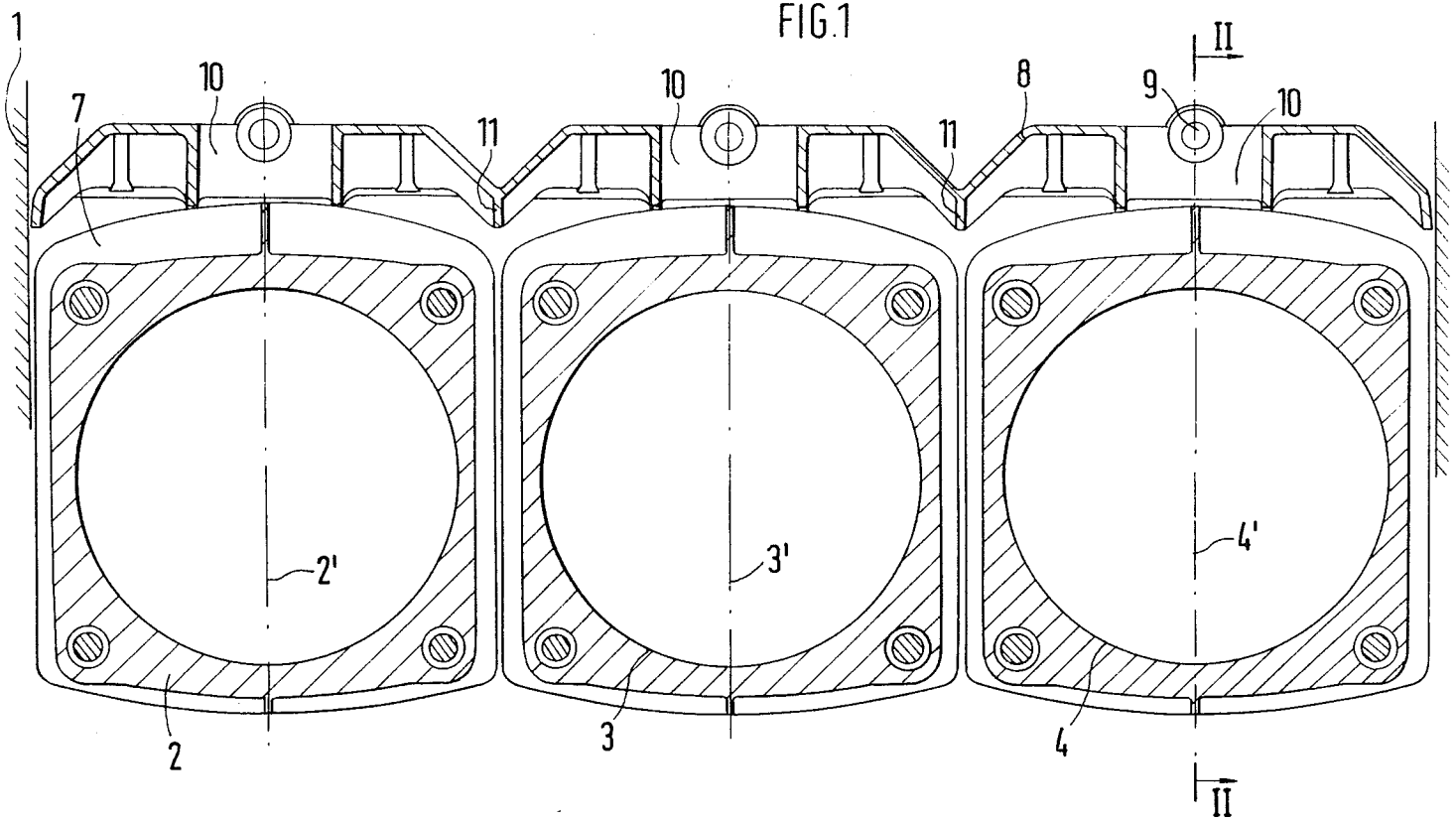
FIG. 1 is a cross-sectional view through a cylinder row of an air-cooled six-cylinder internal combustion engine in accordance with the present invention.
Figure 2:
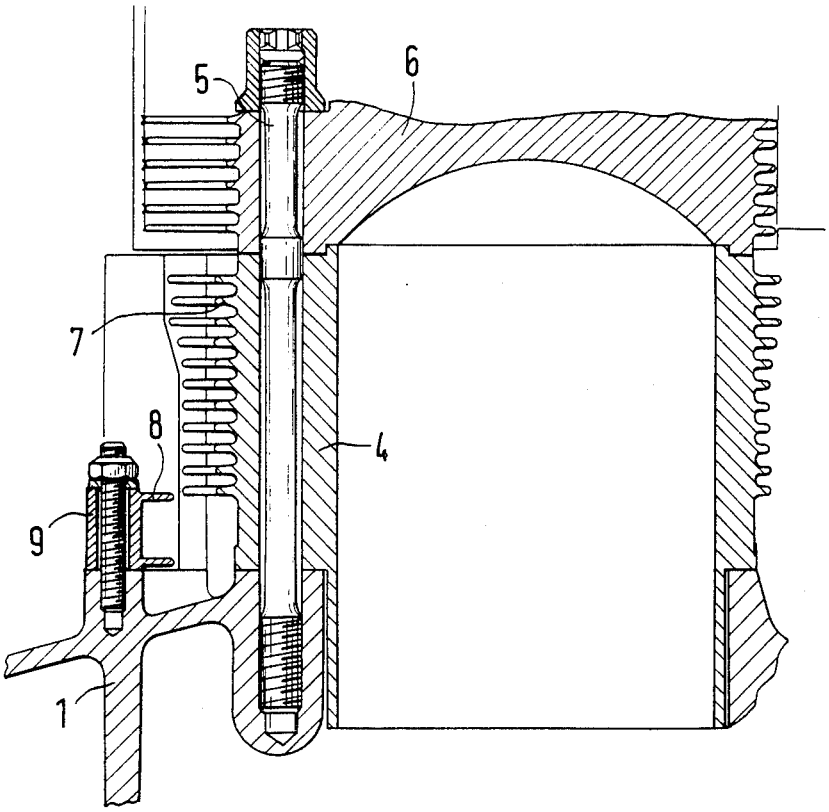
FIG. 2 is a longitudinal cross-sectional view through a cylinder together with the deflection part taken along line II—II of FIG. 1.

Referring now to the drawing wherein like reference numerals are used throughout the various views to designate like parts, according to FIGS. 1 and 2, three individually cast cylinders 2, 3 and 4 are arranged in a row adjacent one another within a crankcase 1 of an internal combustion engine and are threadably secured to the crankcase 1 together with the cylinder heads 6 mounted on the cylinders 2, 3 and 4 by expansion bolts 5. The cylinders 2, 3 and 4 are provided externally about the circumference thereof with ribs extending transversely to their longitudinal axis, between which cooling air is blown through. A deflection part 8, which covers all of the cylinders, is arranged at the cooling-air discharge side of the cylinders; the deflection part 8 is cast in one piece of light metal and is placed over the crankcase at its three fastening eyes 9 disposed axially with respect to the cylinders 2, 3 and 4 and is threadably secured thereat with the crankcase 1. For increasing the form rigidity, the deflection part 8 is constructed double-walled. The fastening eyes 9 are disposed centrally with respect to the air discharge openings 10 which are arranged in the area of the center planes 2', 3', 4' of the cylinders 2, 3, 4, proceed radially to the cylinders and extend over their entire height. Within the area between the cylinders 2, 3, and 3, 4 the deflection part 8 includes V-shaped bent-in portions 11 pointing toward the cylinders 2, 3 and 4 along which the cooling air flowing through the cylinders is deflected by 90° and is conducted to the air discharge openings 10.

Figures 3, 4:
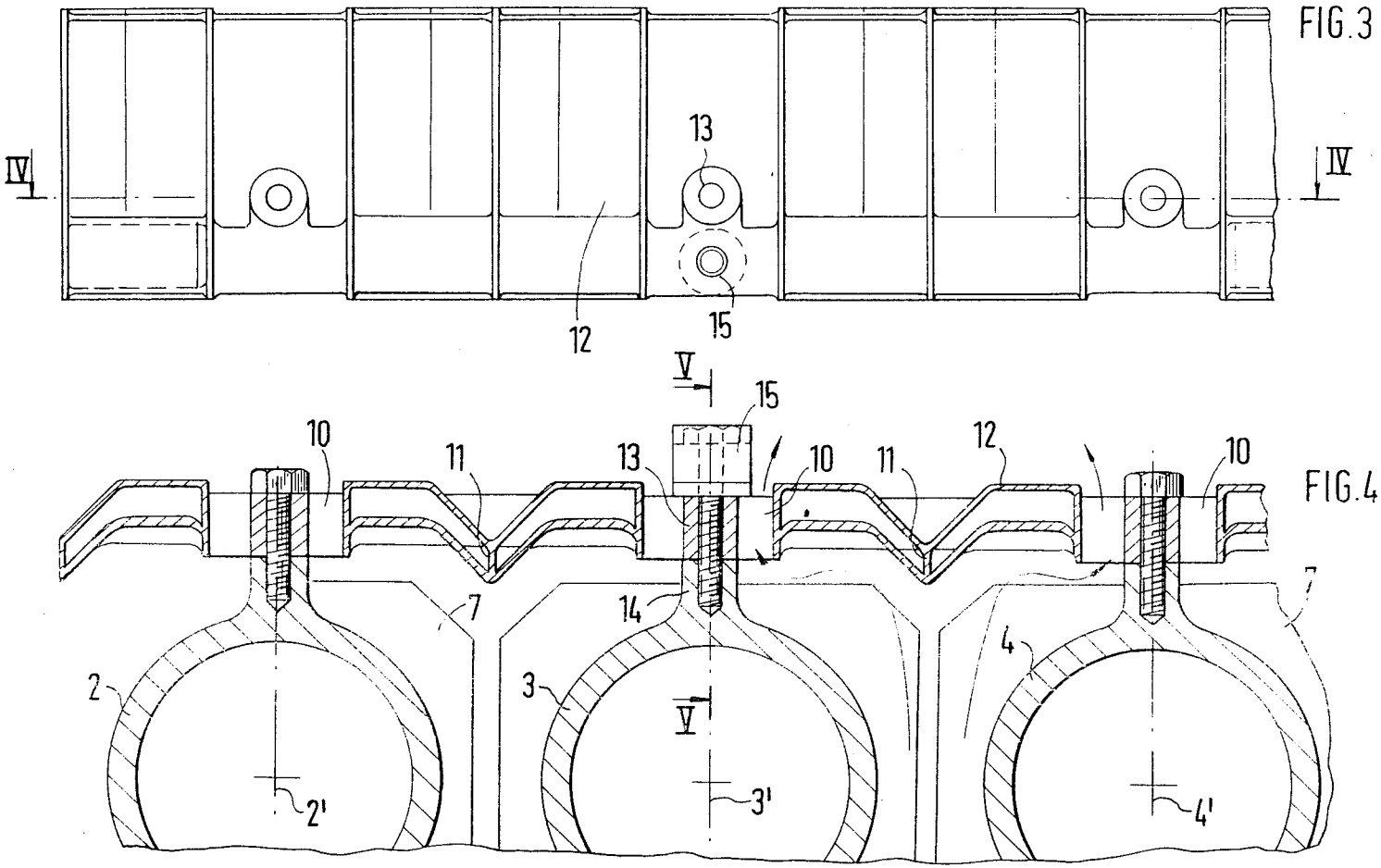
FIG. 3 is a side elevational view of a modified deflection part with a knock sensor in accordance with the present invention.
FIG. 4 is a cross-sectional view through a cylinder row taken along line IV—IV of FIG. 3.
Figure 5:
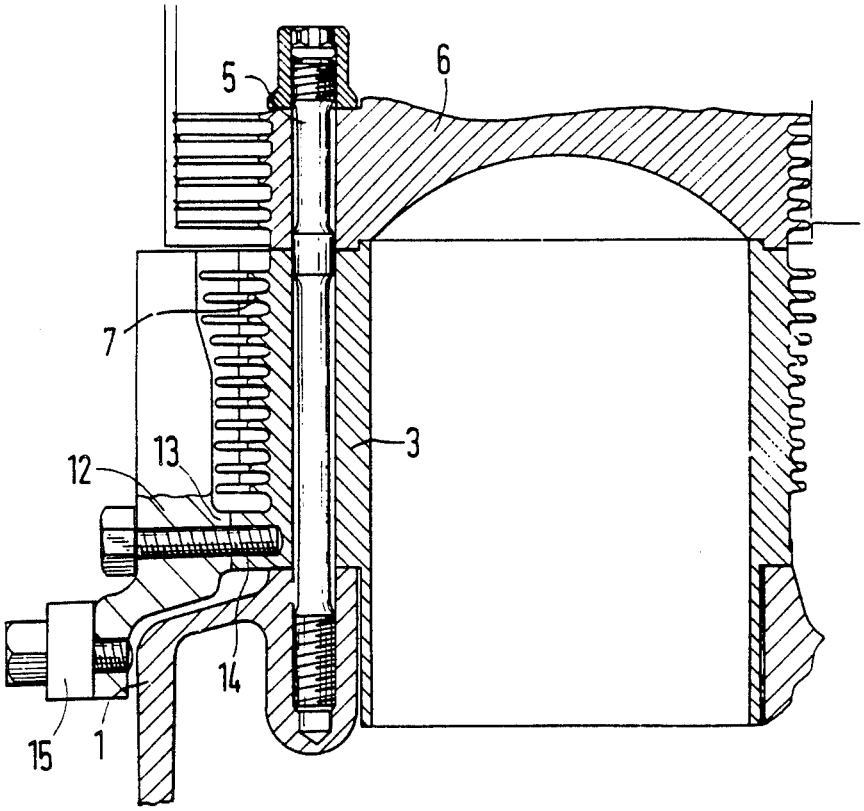
FIG. 5 is a cross-sectional view taken along line V—V of FIG. 4 with longitudinal cross section through a cylinder.

In an embodiment of the present invention according to FIGS. 3, 4 and 5, the deflection part 12 differs from the deflection part 8 in that it includes eyes 13 extending radially to the cylinders, by means of which it is mounted on corresponding eyes 14 of the cylinders 2, 3 and 4 and is screwed together with the same.

In addition to the air guidance, this deflection part 12 serves at the same time as knock-bridge in that it further conducts the noises coming from the cylinders and caused by knocking combustion, to a knock sensor 15 which is threadably secured at the deflection part 12 approximately in the center of its longitudinal dimension.

While we have shown and described only two embodiments in accordance with the present invention, it is understood that the same is not limited thereto but is susceptible of numerous changes and modifications as known to those skilled in the art, and we therefore do not wish to be limited to the details shown and described herein, but intend to cover all such changes and modifications as are encompassed by the scope of the appended claims.

We claim:

1. An air-cooled multi-cylinder internal combustion engine whose cylinders are arranged in a row and clamped in between associated cylinder heads and crankcase, are cast individually and for cooling purposes are provided externally with transversely extending rib means through which cooling air flows in a transverse direction of the cylinders, comprising air guide means arranged at the cooling air discharge side of the cylinders which is constructed as a one-piece deflection means covering all cylinders, wherein the deflection means is mounted on the crankcase and is threadably secured therewith, and wherein the deflection means includes within the area of the center planes of the cylinders, fastening eyes extending in the longitudinal direction thereof.

2. An air-cooled multi-cylinder internal combustion engine whose cylinders are arranged in a row and clamped in between associated cylinder heads and crankcase, are cast individually and for cooling purposes are provided externally with transversely extending rib means through which cooling air flows in a transverse direction of the cylinders, comprising air guide means arranged at the cooling air discharge side of the cylinders which is constructed as a one-piece deflection means covering all cylinders, wherein the deflection means is mounted on the cylinders and is threadably secured with the same, and wherein radially projecting eyes are cast-on at all cylinders within the area of their center planes, the deflection means being threadably secured at said eyes.

3. An internal combustion engine according to claim 2, further comprising a knock sensor mounted on the deflection means approximately centrally to its longitudinal dimension and threadably secured with said deflection means.

4. An air-cooled multi-cylinder internal combustion engine whose cylinders are arranged in a row and clamped in between associated cylinder heads and crankcase, are cast individually and for cooling purposes are provided externally with transversely extending rib means through which cooling air flows in a transverse direction of the cylinders, comprising air guide means arranged at the cooling air discharge side of the cylinders which is constructed as a one-piece deflection means covering all cylinders, and wherein the deflection means is constructed double-walled.

5. An internal combustion engine according to claim 4, wherein the deflection means is cast of light metal or made of plastic material.

6. An internal combustion engine according to claim 4, wherein the deflection means is provided within the area between the cylinders with bent-in portions directed toward the cylinders and with air discharge openings within the area of the center planes of the cylinders.

7. An internal combustion engine according to claim 5, wherein the deflection means is provided within the area between the cylinders with bent-in portions directed toward the cylinders and with air discharge openings within the area of the center planes of the cylinders.

8. An internal combustion engine according to claim 7, wherein the deflection means is mounted on the crankcase and is threadably secured therewith.

9. An internal combustion engine according to claim 8, wherein the deflection means includes within the area of the center planes of the cylinders, fastening eyes extending in the longitudinal direction thereof.

10. An internal combustion engine according to claim 7, wherein the deflection means is mounted on the cylinders and is threadably secured with the same.

11. An internal combustion engine according to claim 10, wherein radially projecting eyes are cast-on at all cylinders within the area of their center planes, the deflection means being threadably secured at said eyes.

12. An internal combustion engine according to claim 11, further comprising a knock sensor mounted on the deflection means approximately centrally to its longitudinal dimension and threadably secured with said deflection means.

* * * * *